US005461449A

United States Patent [19]

Shimamura et al.

[11] Patent Number: 5,461,449

[45] Date of Patent: Oct. 24, 1995

[54] METHOD AND MEANS FOR SEPARATING LEADER FROM FILM IN PHOTOGRAPHIC PROCESSING MACHINE

[75] Inventors: Yasunobu Shimamura; Takuya Yamamoto; Hisashi Negoro; Yutaka Kiyonaga; Shigeru Masuda, all of Wakayama, Japan

[73] Assignee: Noritsu Koki Co., Ltd., Wakayama, Japan

[21] Appl. No.: 310,081

[22] Filed: Sep. 22, 1994

[30] Foreign Application Priority Data

Sep. 24, 1993 [JP] Japan ..... 5-238336
May 20, 1994 [JP] Japan ..... 6-107053

[51] Int. Cl.[6] ..... G03D 3/08

[52] U.S. Cl. ..... 354/320; 354/321; 354/323

[58] Field of Search ..... 354/319–322; 355/27–29

[56] References Cited

U.S. PATENT DOCUMENTS 4,185,912 1/1980 Schwartz ..... 354/322
4,864,354 9/1989 Crasnianski ..... 354/322
5,307,114 4/1994 Nitsch et al. ..... 355/29

FOREIGN PATENT DOCUMENTS 4110642 8/1992 Germany .
4-141646 5/1992 Japan ..... 354/323

OTHER PUBLICATIONS

Patent Abstracts of Japan, vol. 16, No. 421 (P–1414) Sep. 4, 1992.

*Primary Examiner*—D. Rutledge
*Attorney, Agent, or Firm*—Wenderoth, Lind & Ponack

[57] ABSTRACT

The leader attached to a web of film is cut from the film while processing the film in a photographic processing machine. Before feeding the film to the printing unit, the leader is separated from the film. At a turning point where the film feed direction extending from the film drying unit to the printing unit changes, the film is fed straight ahead and the leader is cut off the film by a cutter. The film is fed back in a reverse direction and its end is turned up by a guide. When the printing unit gets vacant, the film without the leader is fed into the printing unit.

3 Claims, 16 Drawing Sheets

METHOD AND MEANS FOR SEPARATING LEADER FROM FILM IN PHOTOGRAPHIC PROCESSING MACHINE

BACKGROUND OF THE INVENTION

This invention relates to a photographic processing machine for automatically developing and drying film, printing images on the films onto photographic paper, and developing and drying the photographic paper.

As shown in FIG. 16, this type of photographic processing machine has a film developing unit A comprising a plurality of treating tanks, a film drying unit B, a printing unit C, a printed paper developing unit D having a plurality of processing tanks, and a printed paper drying unit E. Films F are fed through the units A, B and C. Web of photographic paper P is fed through the units C, D and E. While feeding films and photographic paper, the films are developed and dried and the images thereon are printed onto the photographic paper. The thus printed photographic paper is developed and dried. These steps are all carried out automatically. The numerals used in FIG. 16 refer to the same elements shown in the other figures showing the embodiments of this invention. Thus, these elements are described in more detail in the description of the embodiments.

Since the images on the undeveloped films are not fixed, it is preferable to keep them out of contact with the film feed rollers where possible. To feed films stably, a leader should be attached to the leading end of each film. Thus, as shown in FIG. 15, it is an ordinary practice to attach (bond) a leader L to the leading end of a film F. The film is fed through the film developing unit A and the film drying unit B with its side edges guided by the guides while having the leader L sandwiched between the feed rollers.

In the photographic art, the film developing unit A and film drying unit B are usually referred to comprehensively as a film processor, while the printing unit C, printed paper developing unit D and printed paper drying unit E are comprehensively called a printer processor.

Although it is a convenient way to feed a film F guided by a leader L in the film processor, it is difficult, considering the structure of the film printing unit C, to feed the film F through the unit C (into the feed path in the negative mask 14) with the leader L attached thereto. Thus, as shown in FIG. 16, it was heretofore necessary to provide the film processor including the film developing unit A separately from the printer processor including the printing unit C in order to separate a leader L from every film F fed out of the film processor by peeling off an adhesive tape t or by cutting the film F leading end along the chain line and then to insert by hand the film, now free of the leader, into the film inlet 14*a* of the printer processor. Such work is extremely troublesome and time-consuming.

In order to solve this problem, Unexamined Japanese Patent Publication 3-265851 discloses a solution for automatically cutting off a leader L and feeding the leader-free film into the printer processor. But in this arrangement, since a leader L is cut off while feeding a film along a straight feed path, complicated steps were needed to dispose of the cut-off leaders.

Also, in order to feed films in a straight line, a rather long photographic processing machine is needed. It is especially difficult nowadays to find a place which allows for the installation of such a long apparatus. A compact apparatus is thus desired. One way to reduce the size of the processing machine is to change the positional relation between the film processor and the printer by reversing the film feed direction at the mid-point of the film feed path.

It is an object of this invention to provide a means which permits smooth separation of leaders even when the film feed path is reversed at its mid-point.

SUMMARY OF THE INVENTION

In order to achieve the above object, according to this invention, there is provided in a photographic processing machine comprising a film developing unit, a film drying unit, a printing unit, a photographic paper developing unit and a photographic paper drying unit that are arranged continuously, a method of separating a leader from a film, the method comprising the steps of feeding a film having a leader attached to the leading end thereof through the film developing unit and the film drying unit to develop and dry the film, separating the leader from the film, feeding the film into the printing unit, and feeding photographic paper through the printing unit, the photographic paper developing unit and the photographic paper drying unit to print images on the film onto the photographic paper and to develop and dry the photographic paper, characterized in that the film with the leader is fed until it protrudes from a turning point where the film feed direction in the film feed path extending from the film drying unit to the printing unit changes, stopping the feed of the film with the leader at the turning point, cutting off the leader from the film, moving the film backwards until its leading end comes back to the turning point, and feeding the film along the film feed path leading to the printing unit into the printing unit.

There is also provided a photographic processing machine comprising a film developing unit, a film drying unit, a printing unit, a photographic paper developing unit and a photographic paper drying unit that are arranged continuously, wherein a film having a leader attached to the leading end thereof is fed through the film developing unit and the film drying unit to develop and dry the film, and wherein photographic paper is fed through the printing unit, photographic paper developing unit and photographic paper drying unit to print images on the film onto the photographic paper and to develop and dry the photographic paper, characterized in that the film feed path extending from the film drying unit to the printing unit has a turning point at which its direction is changed, and that the processing machine further comprises a roller provided at the turning point for feeding the film back and forth, a guide provided at the turning point for selectively feeding the film straight ahead or toward the printing unit, and a cutter provided downstream of the guide for cutting off the leader.

This apparatus may further comprises film stocking units in which the film can be stored in the form of length-adjustable loops.

According to this invention, when the film end reaches the turning point where the direction of the film feed path extending from the film drying unit (film processor) to the printing unit (printer processor) changes, with the changeover guide in the position for feeding the film straight ahead, the film end (leader) is moved straight ahead by the roller and stopped when it has moved past the cutter. Then, the leader is cut off by the cutter. Since the leaders are cut off at a point off the main film feed path, they can be easily disposed of.

After separating the leader, the film is changed until its leading end reaches the turning point. Then, the changeover guide is moved to the position for feeding the film toward the printing unit. When the printing unit becomes vacant, this film is fed into the printing unit by driving the feed rollers.

By providing film stocking units, it is possible to stock the film in the form of loops. Thus, even when the film end (leader) is moved back and forth by the feed rollers, only the loops extend or shrink, keeping the remaining portion of the film stationary. Thus, such back-and-force movement of the film end will have no influence on the preceding steps such as the film drying step.

According to this invention, a leader is separated from each film at a turning point of the film feed direction by moving the leading end of the film (and thus the leader) back and forth. Thus, the separated leaders can be disposed of easily. The leader separating means of this invention can be employed in any photographic processing machine of the type having a turning point in the film feed path from the film processor to the printer processor. This makes it possible to reduce the size of the entire apparatus.

Other features and objects of the present invention will become apparent from the following description made with reference to the accompanying drawings, in which:

DETAILED DESCRIPTION OF THE PREFERRED EMBODIMENT

Figure 5:
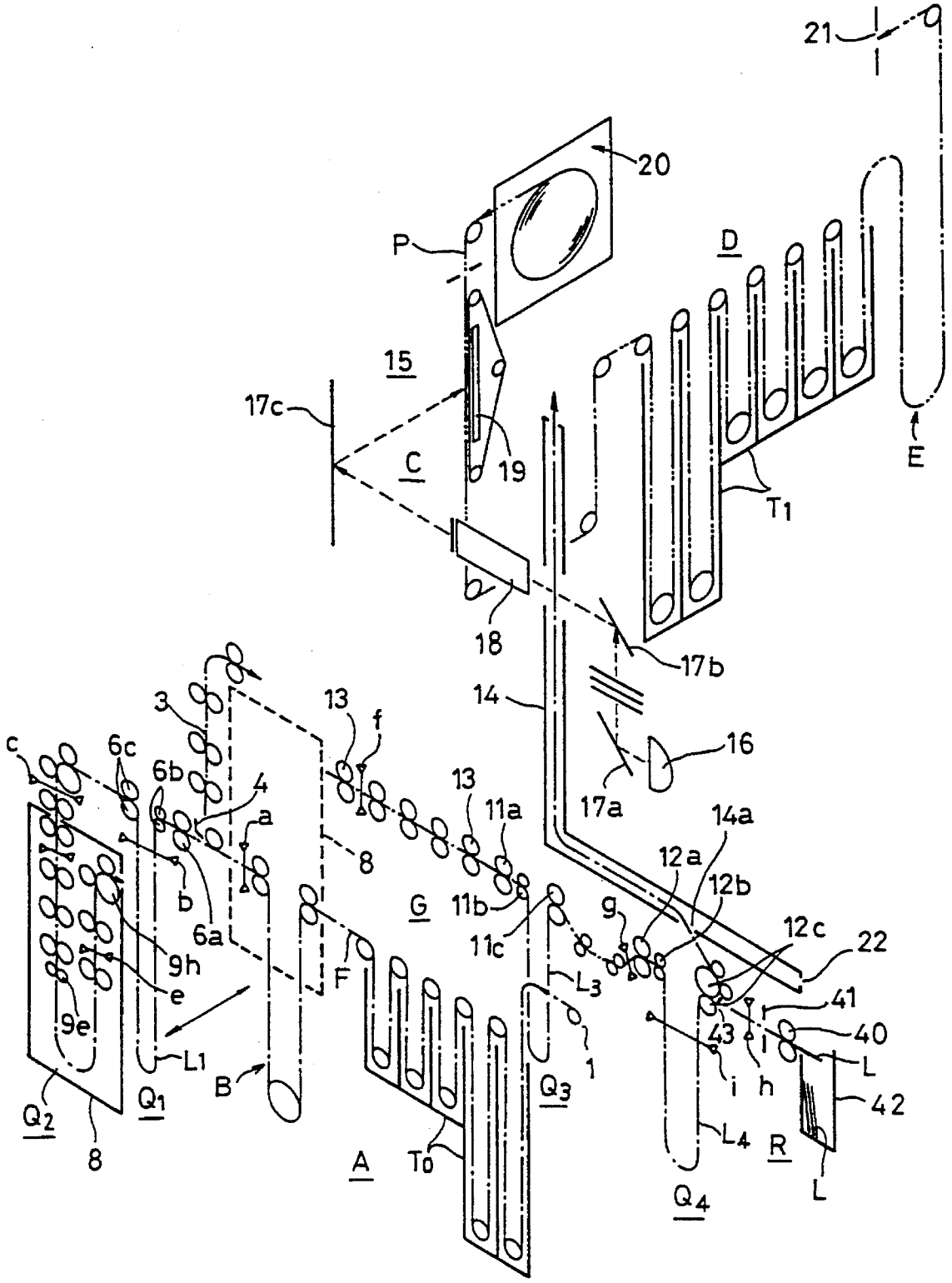
FIG. 5 is a schematic perspective view of the same.

FIGS. 1–13 show one embodiment of this invention. FIG. 5 schematically shows this embodiment. A film F, having a leader L attached to its leading end, is fed manually into the film developing unit A through its film inlet 1. It is then automatically developed by being fed through treating solutions in a plurality of treating tanks To, guided by the leader L. The film F thus developed is fed into the film drying unit B and dried. After drying, it is fed toward a first film stocking unit Q1.

Figure 1:
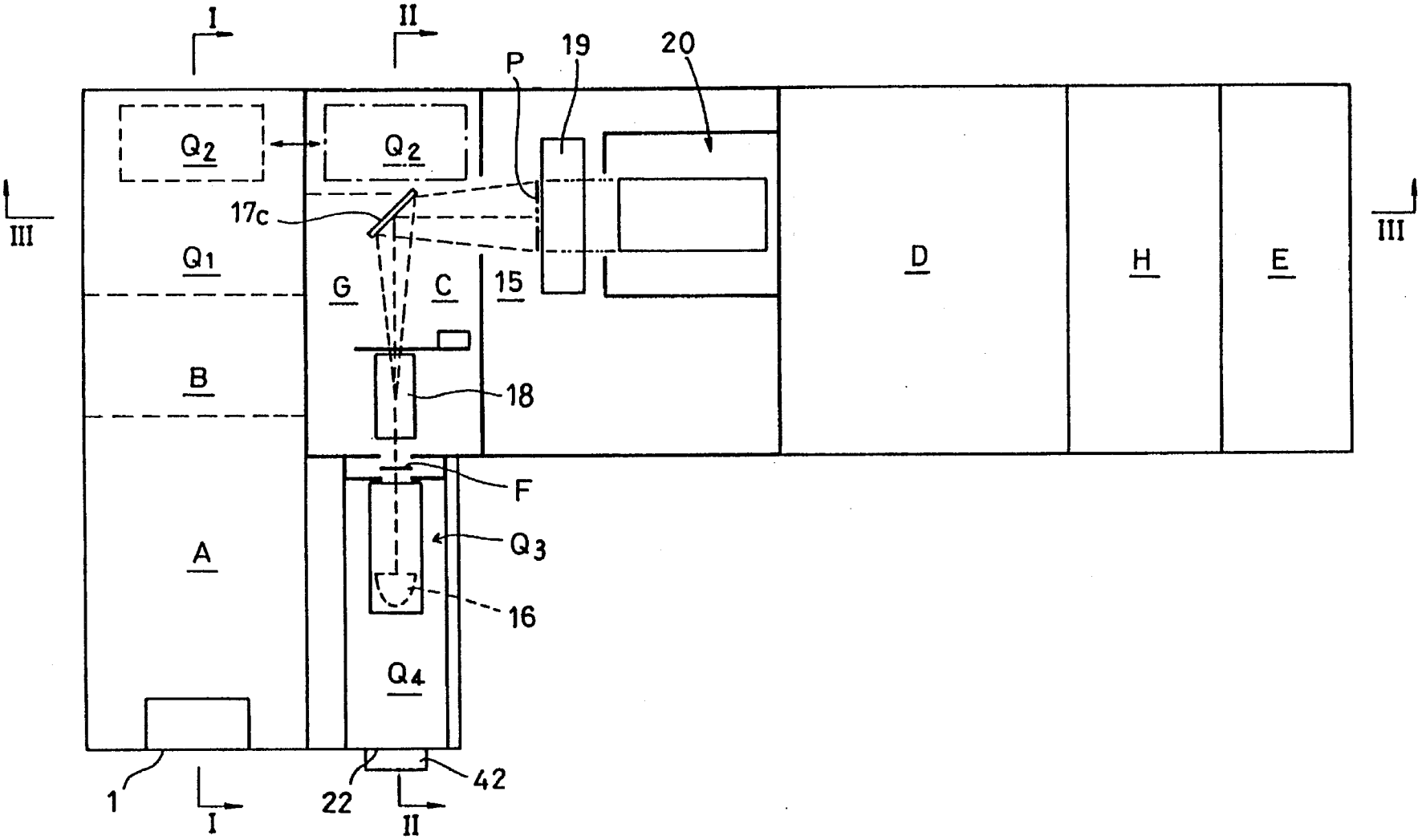
FIG. 1 is a plan view of one embodiment.
Figure 2:
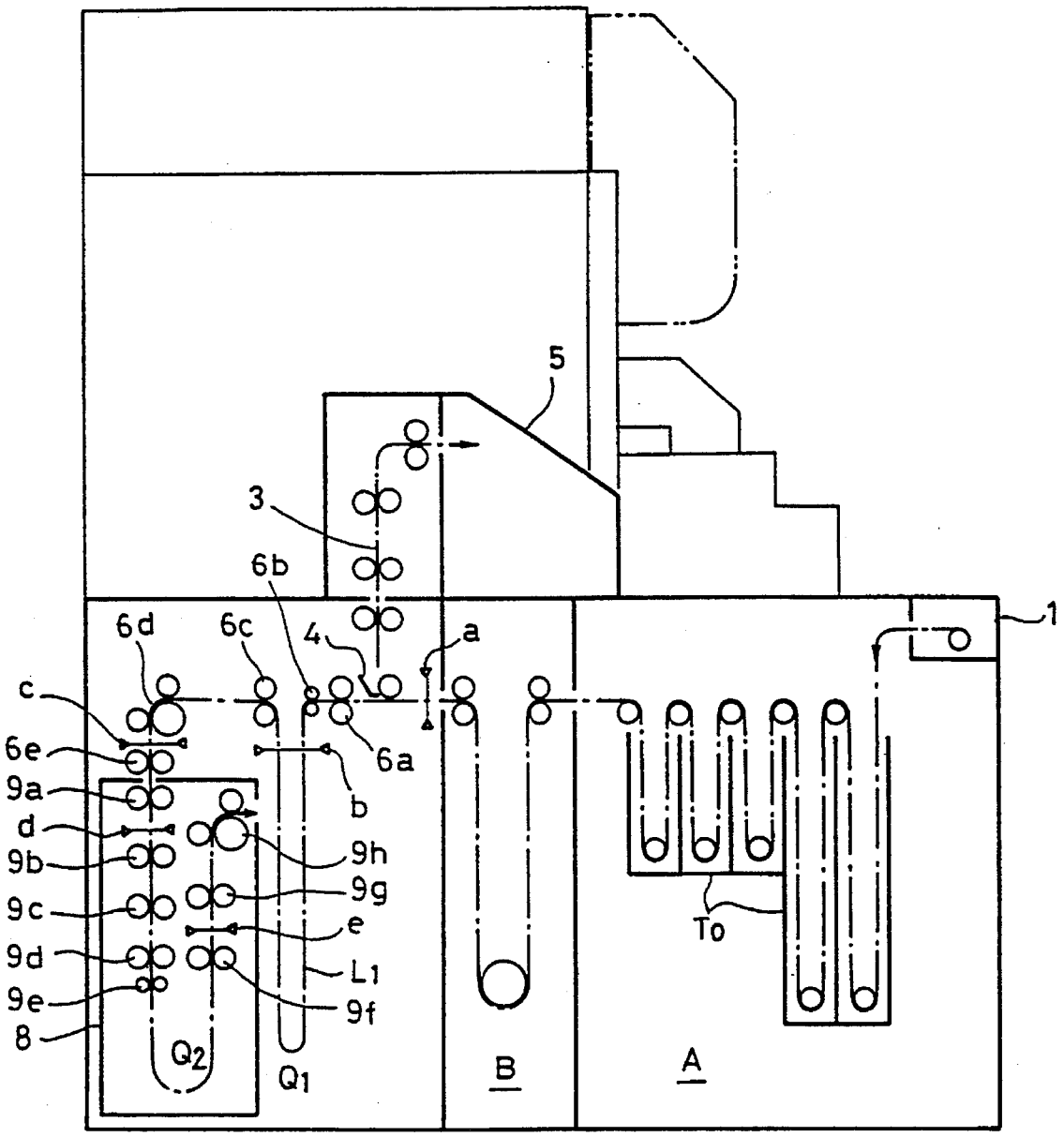
FIG. 2 is a sectional view taken along line I—I of FIG. 1.
Figure 6:
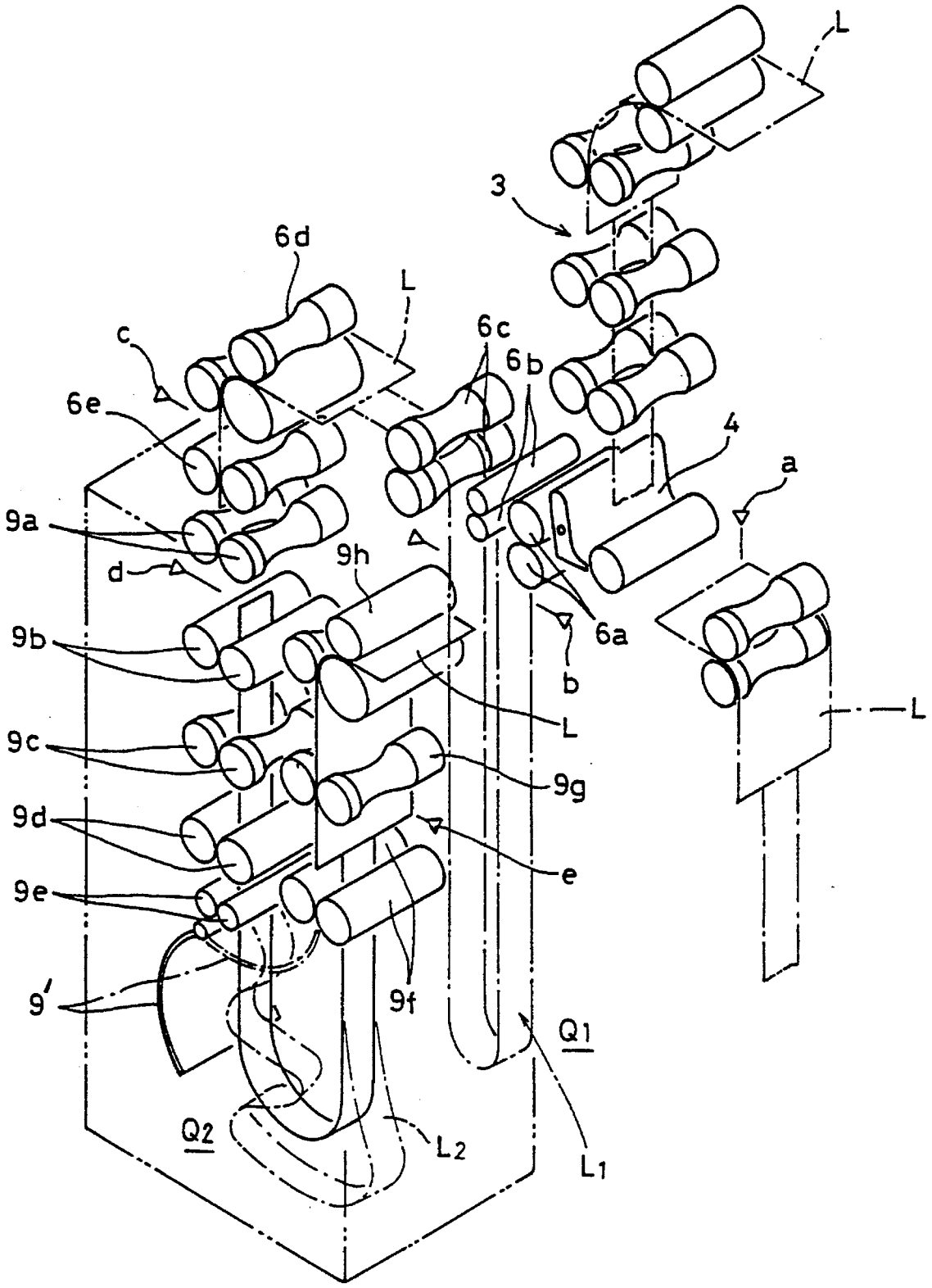
FIG. 6 is a schematic perspective view of a portion of the same.
Figure 7A:
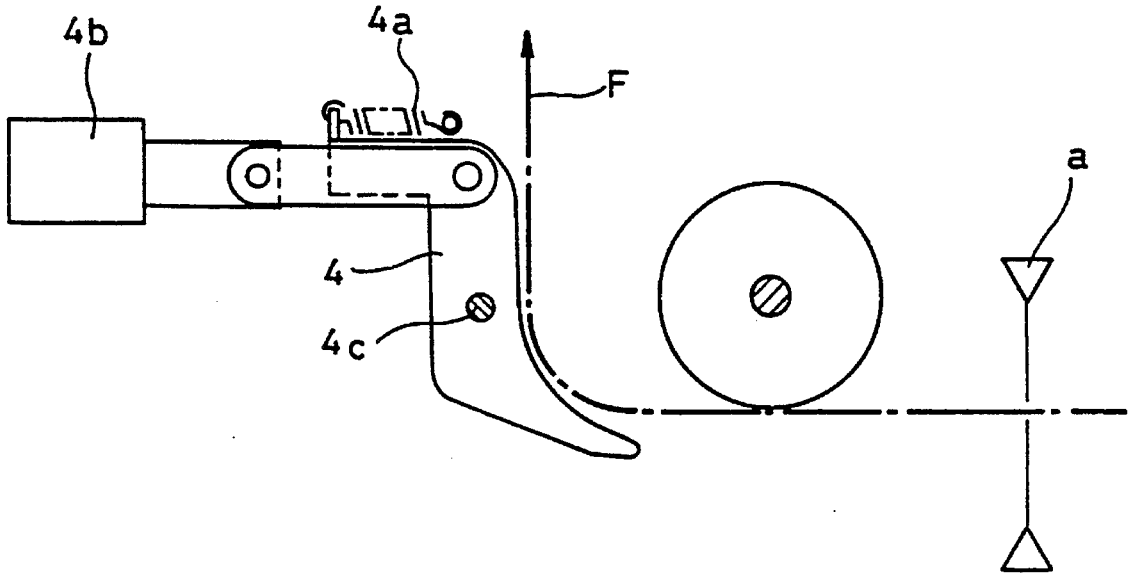
FIGS. 7A and 7B are schematic views of the same showing how it operates.

Upstream of the film stocking unit Q1 is a changeover guide 4 for changing over the feed direction toward a film discharge route 3 (see FIGS. 5–7). The changeover guide 4 is normally urged downward about a pivot center 4*c* by a spring 4*a* as shown in FIG. 7A so that its free end is located along the feed path of the film F. The film F is thus fed into the film discharge route 3 and then into a film stocker 5 (FIG. 2). Films are fed in this direction when films are only to be developed or if any unit in the later stage such as the first film stocking unit Q1 should fail. Films can be discharged manually from the film developing unit A through the changeover guide 4 into the film stocker 5 in case of e.g. power failure.

Figure 7B:
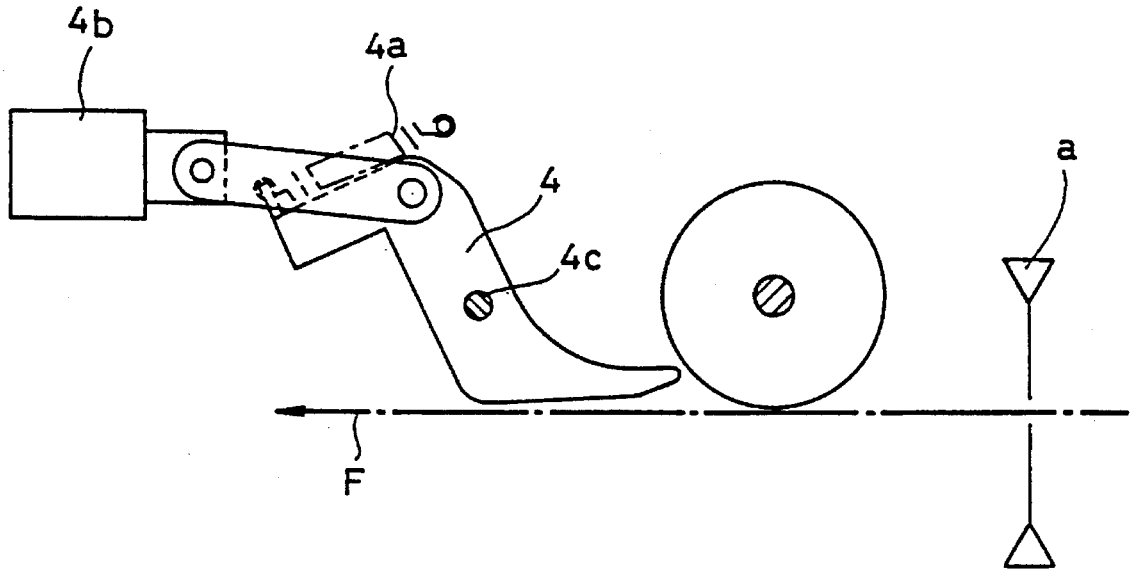

On the other hand, when developing and then printing films, the changeover guide 4 is turned by a solenoid 4*b* as shown in FIG. 7B as soon as the leading end of film F is detected by a sensor a located immediately before the guide 4 so that its free end gets out of the film feed path. The film F is thus fed straight ahead to the first film stocking unit Q1.

The first film stocking unit Q1 has a plurality of pairs of feed rollers 6 that are arranged in one direction. The film F is fed in one direction or forms a loop L1 by turning or stopping the feed rollers 6*a*, 6*c*.

Namely, as shown in FIGS. 5 and 6, after passing through the changeover guide 4, the film F with the leader L is fed straight ahead by the feed rollers 6*a* and 6*c* and then turned downwards by a feed roller 6*d*. After its leading end has been detected by a sensor c, the film is further fed a predetermined distance. When the film leading end is caught between the feed rollers 6*e*, the feed rollers 6*c* and 6*d* are stopped. On the other hand, the feed rollers 6*a* keep rotating, feeding the film F ahead. Thus, the loop L1 is formed. Even after the rear end of the film F has passed by the feed rollers 6*a*, the film is still held between the free press rollers 6*b*. The loop L1 is thus maintained. The rollers are driven by a pulse motor.

When the second film stocking unit Q2 is in a predetermined position (shown by solid line in FIG. 5), the feed rollers 6*c*, 6*d* and 6*e* begin turning when the sensor a detects the rear end of the film F or when the sensor b confirms the loop L1. The film F is thus fed into the second film stocking unit Q2. On the other hand, if the unit Q2 is not in the predetermined position, the loop L1 is formed and maintained. In this state, when the second film stocking unit Q2 moves to the predetermined position, the film F is fed into the unit Q2.

Figure 8:
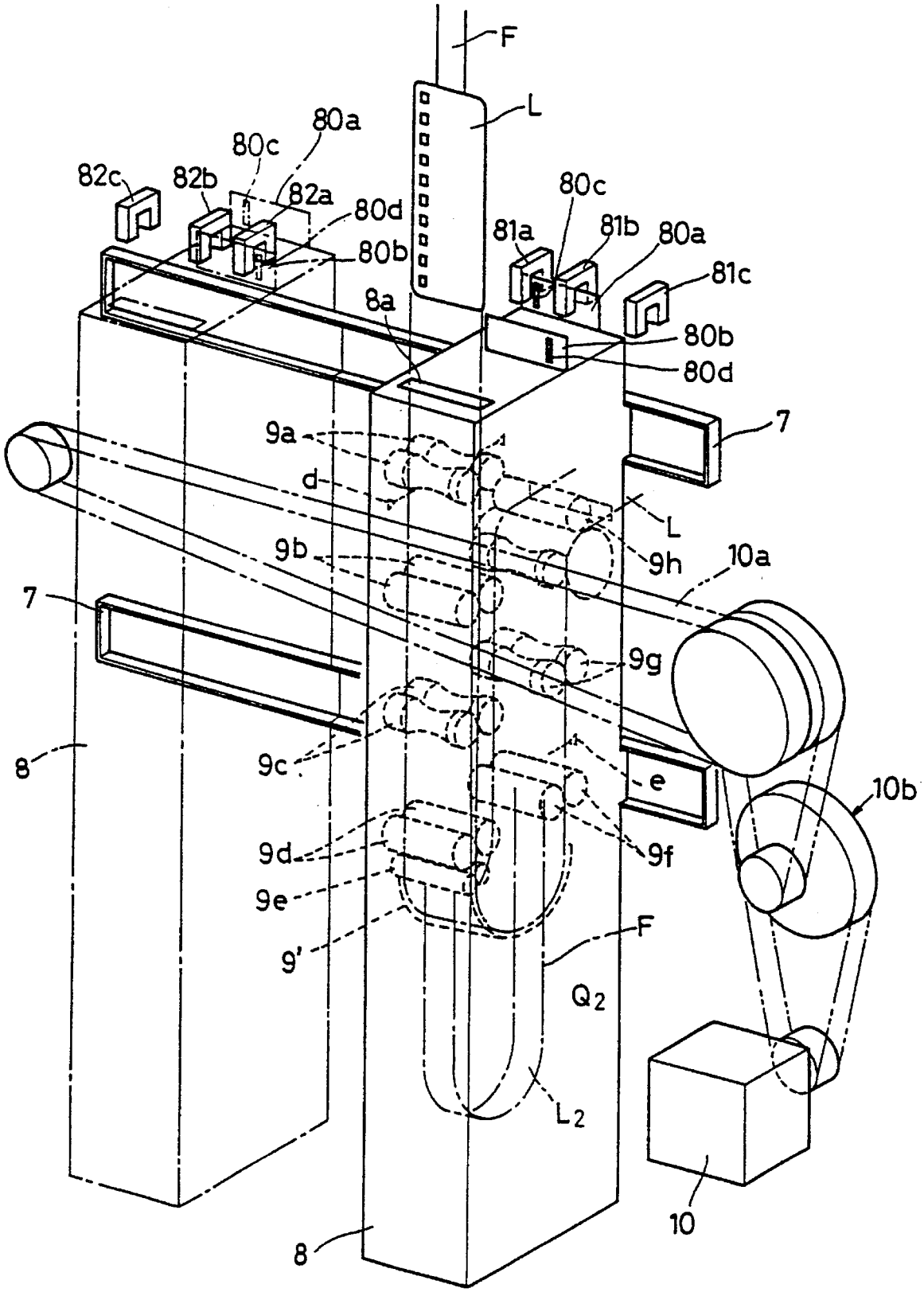
FIG. 8 is a schematic perspective view of a portion of the same.
Figure 9:
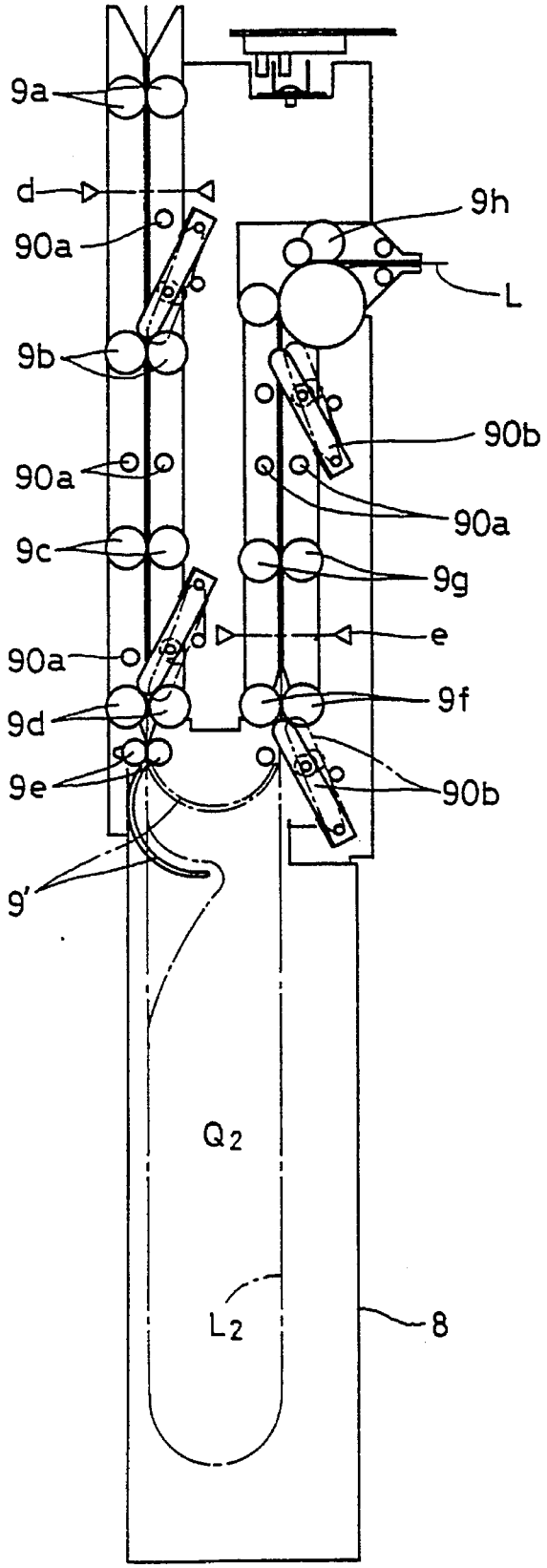
FIG. 9 is a schematic sectional front view of a portion of the same.

As shown in FIGS. 6, 8 and 9, the second film stocking unit Q2 is mounted in a casing 8 movable along lateral rails 7. The film F which has been sent from the first film stocking unit Q1 is fed into the second film stocking unit Q2 through an inlet 8*a* formed in the top thereof. A loop L2 is formed by controlling feed rollers 9*a*, 9*b* . . . .

Namely, feed rollers 9*a*, 9*b*, 9*c* and 9*d* are driven by a single common pulse motor, while feed rollers 9*f*, 9*g* and 9*h* are driven by another pulse motor. When a guide plate 9' is in the position shown by chain line in FIG. 9, the film F fed through the inlet 8*a* is run along a U-shaped path by synchronously driving the feed rollers 9*a* . . . 9*h*. When a sensor e detects the leading end of the film, the rollers 9*f*–9*h* are stopped for a predetermined time period, while the guide plate 9' moves back to the position shown by solid line. The film F is looped at L2 in the casing 8 with its leading end turned forwardly by the feed roller 9*h*. The formation of the loop L2 is completed when the rear end of the film F is caught between the idling press rollers 9e. On the other hand, the sensor d checks whether the film F has been completely pulled into the casing 8. The feed rollers 9a–9d are then stopped.

Figure 11B:
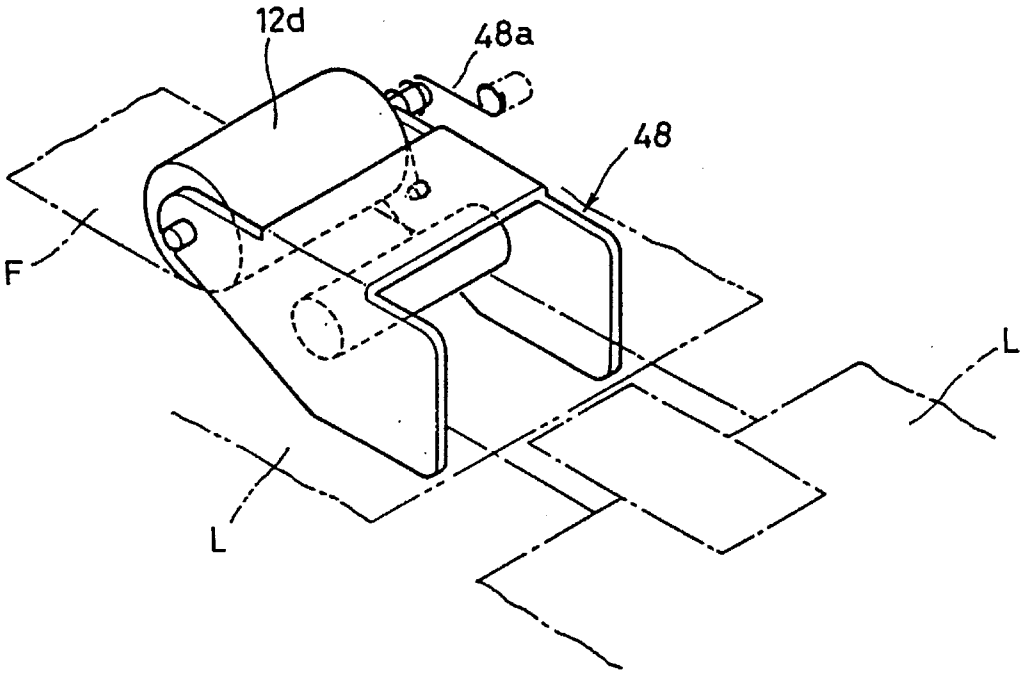
FIGS. 11A and 11B are perspective views of the film guide of the same.
Figure 11A:
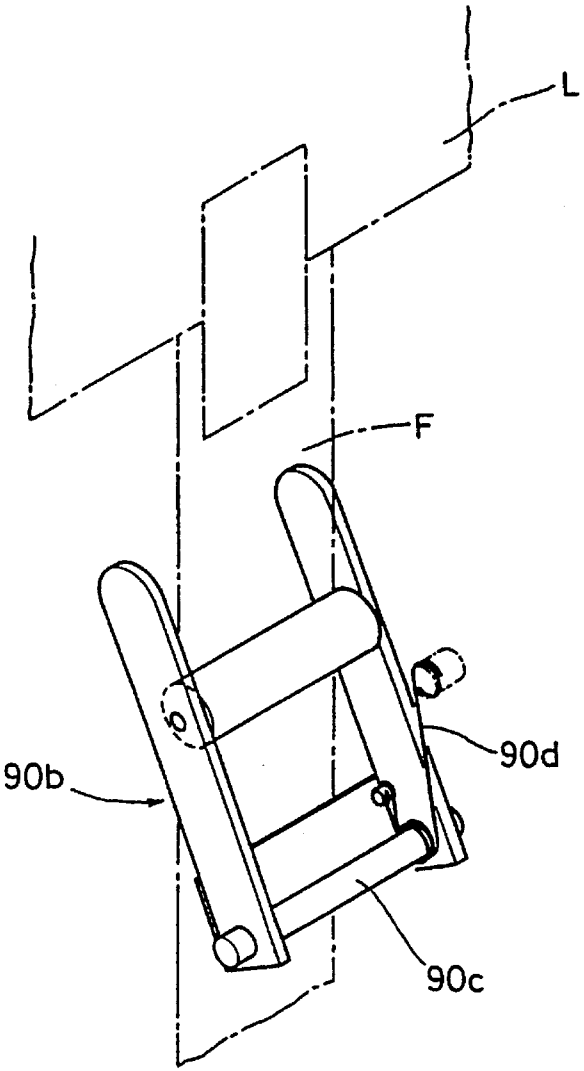

Though not shown in FIGS. 6 and 8, cylindrical auxiliary rollers 90a and film guides 90b are provided in the casing 8 as shown in FIG. 9. As shown in FIG. 11A, each film guide 90b is pivotally mounted on a support shaft 90c secured to a base e.g. the casing 8. Normally, the guides 90b are urged to the position shown by solid lines in FIG. 9 by springs 90d to guide the film F as shown in FIG. 11A. Upon contact with the leader L, they are swung back as shown by chain lines in FIG. 9, allowing the passage of the leader to pass.

The casing 8 is moved by a pulse motor 10 through a speed reducer 10b and a belt 10a. The casing 8 carries on its top two parallel detection plates 80a and 80b. Three sensors each 81a, 81b and 81c and 82a, 82b and 82c are provided along the respective travel paths of the detection plates 80a and 80b. While the detection plates 80a, 80b are passing through between the respective sensors 81a . . . , 82a . . . , they are turned off because the lights transmitted across the respective sensors are blocked by the detection plates 80a, 80b.

When the detection plates 80a, 80b move into between the first sensors 81a, 82a, blocking the lights transmitted thereacross, they are turned off. When the detection plates move further ahead and get into between the second sensors 81b, 82b, they are turned off. When slits 80c, 80d formed in the respective detection plates 80a, 80b are located between the first sensors 81a, 82a, the first sensors are turned on. In this position, i.e. the position in which the first sensors 81a, 82a are on and the second sensors 81b, 82b are off, the pulse motor 10 is stopped. The casing 8 is thus maintained in this position. If the casing 8 should overrun, thus turning the third sensors 81c, 82c off, the pulse motor 10 will be turned in reverse direction to move the casing 8 back until the first sensors 81a, 82a, which has been turned on and then off, is turned on again (until the slits 80c, 80d move into between the first sensor again). Thus, the third sensors 81c, 82c detect the respective ends of the casing 8.

After stocking one film F in the second film stocking unit Q2, the casing 8 is moved laterally to the position shown by chain line in FIG. 8 and stopped. The casing 8 may be moved by controlling the number of pulses given to the motor 10.

In the position shown by chain line of FIG. 5, the casing 8 is aligned with a straight feed unit G that runs parallel to the film F feed path in the film developing unit A. Thus, the film stocked in the second film stocking unit Q2 is fed out through its outlet 8b formed in the front side thereof toward the straight feed unit G. From the unit G, the film F is fed to third and then fourth film stocking units Q3 and Q4.

Figure 3:
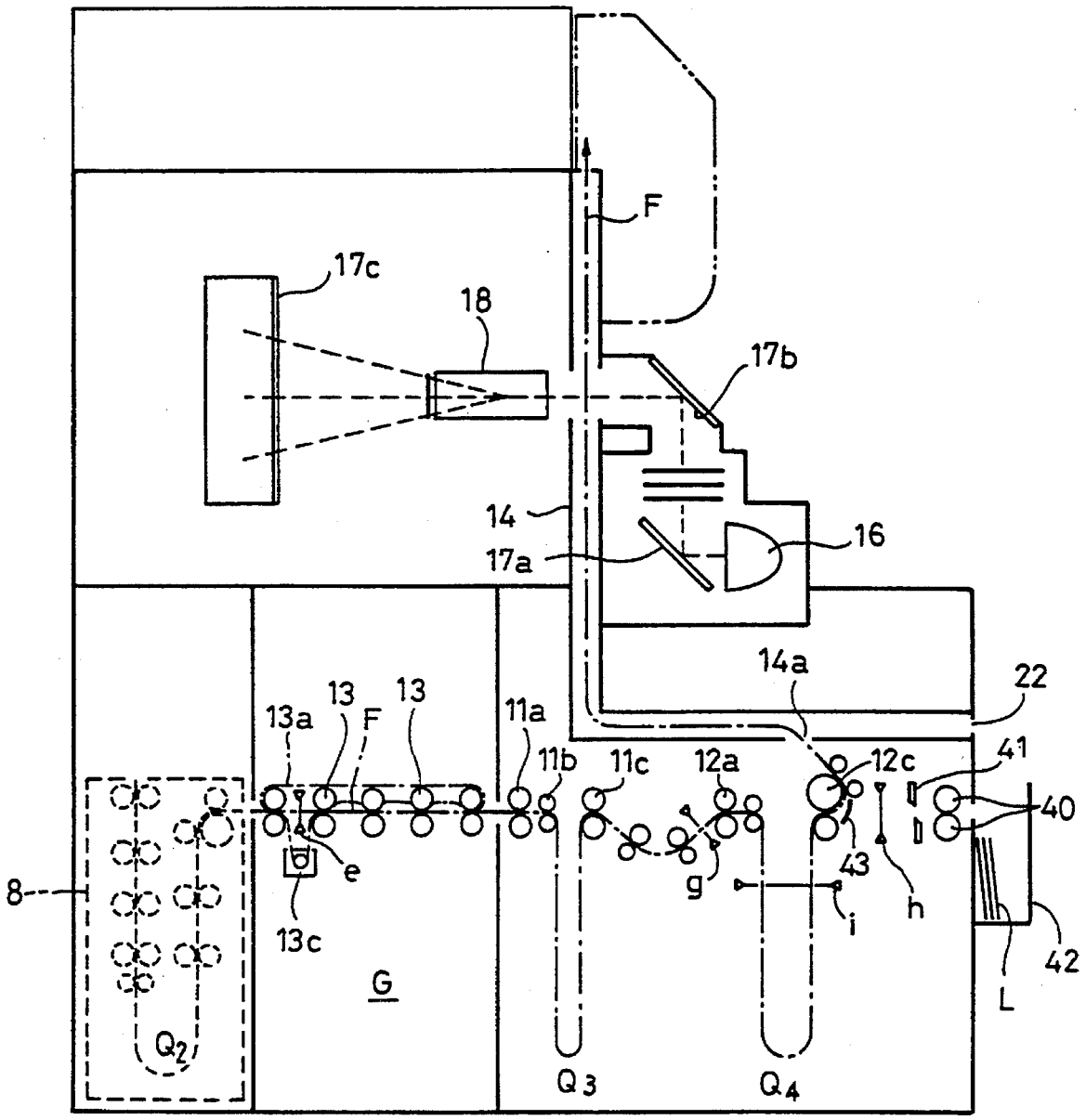
FIG. 3 is a sectional view taken along line II—II of FIG. 1.
Figure 4:
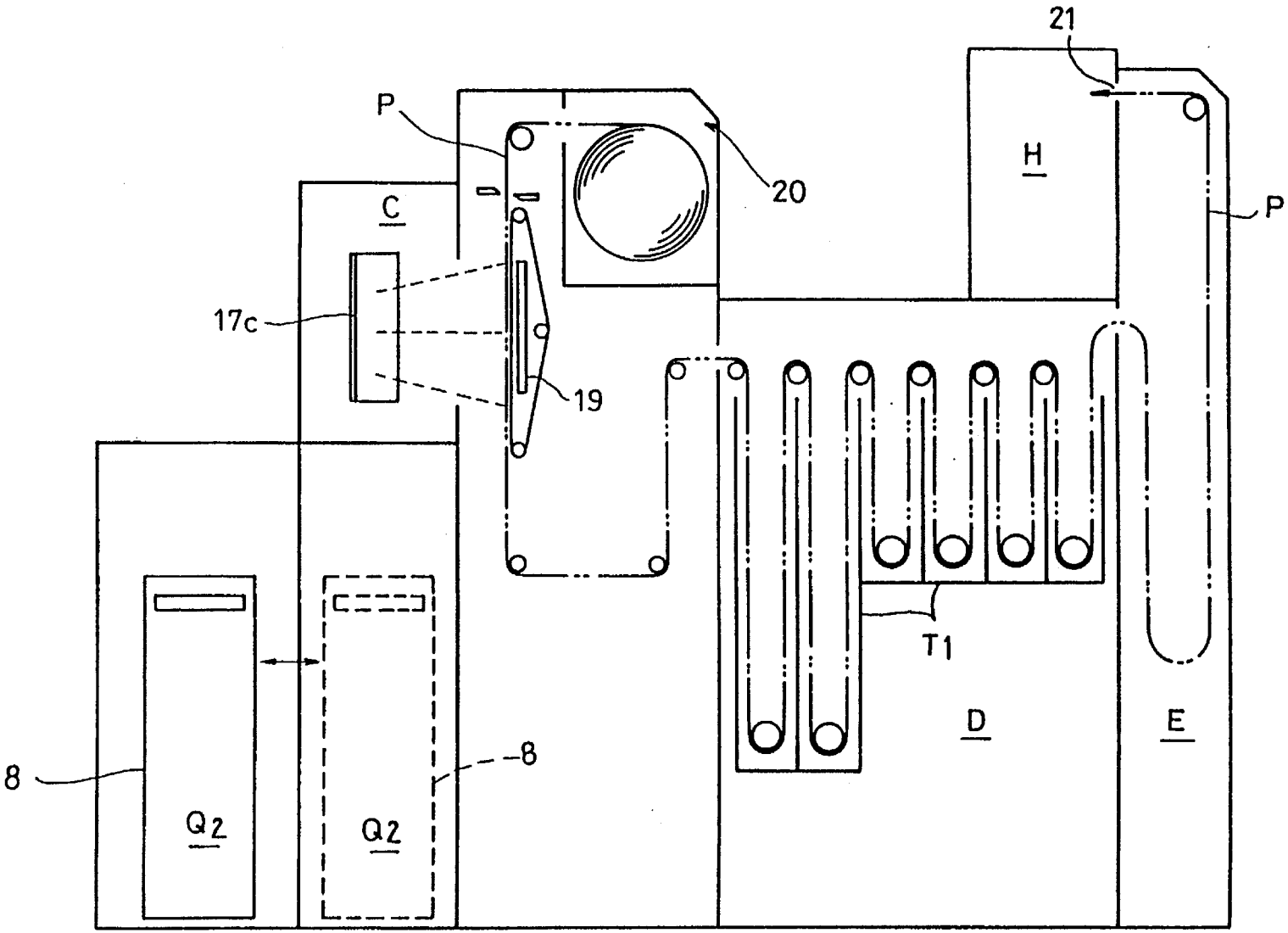
FIG. 4 is a sectional view taken along line III—III of FIG. 1.

The film F in the second film stocking unit Q2 is fed out by means of feed rollers 9f–9h. When a sensor1 f detects the rear end of the film F, the casing 8 is moved back to the position behind the first film stocking unit Q1 (the position shown by solid line of FIG. 5). The straight feed unit G has a plurality of feed rollers 13 and a belt 13a wound therearound. The film F is fed by rotating the feed rollers 13 by a pulse motor 13c through the belt 13a (FIG. 3).

The third and fourth film stocking units Q3, Q4 have rollers 11a–11c and 12a–12c and sensors g, h and i which are similar to those for the first film stocking unit Q1 to stock films F therein. If no film F is stocked in the fourth film stocking unit Q4, a film fed into the third film stocking unit Q3 is not stocked in the unit Q3 but fed toward the fourth film stocking unit Q4.

Namely, the sensor i, which is similar to the sensor b, detects whether or not there is a loop L4 in the fourth film stocking unit Q4. If not, the feed rollers 11c keep rotating, so that the film F is fed into the fourth film stocking unit Q4 without forming a loop L3 in the unit Q3. On the other hand, if the loop L4 is detected, after the leading end of the film F is detected by the sensor g, the feed rollers 11c are stopped and caught between the feed rollers 12a. A loop L3 is thus formed in the unit Q3 because the feed rollers 11a keep rotating.

Figure 10:
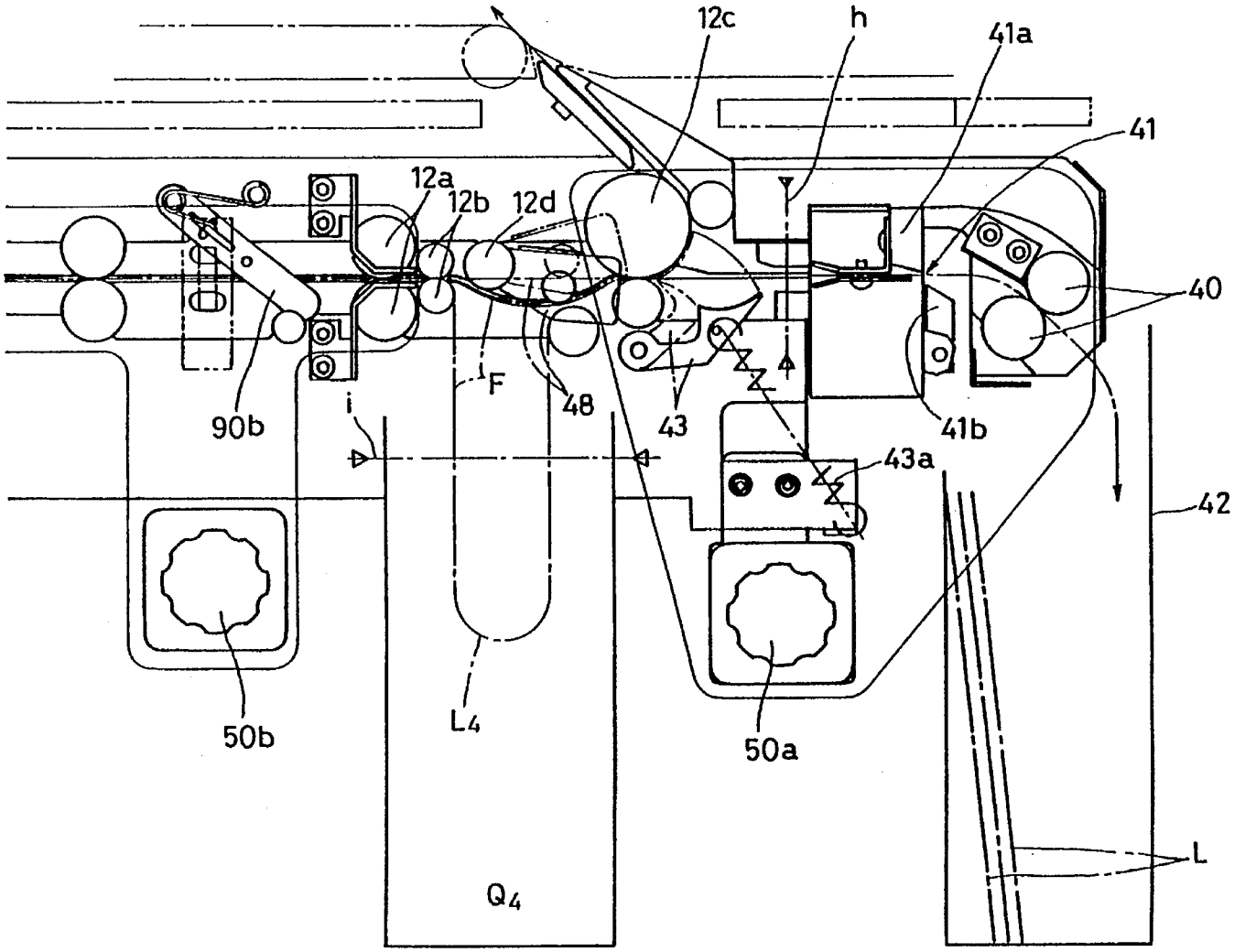
FIG. 10 is a schematic front view of a portion of the same.
Figure 12A:
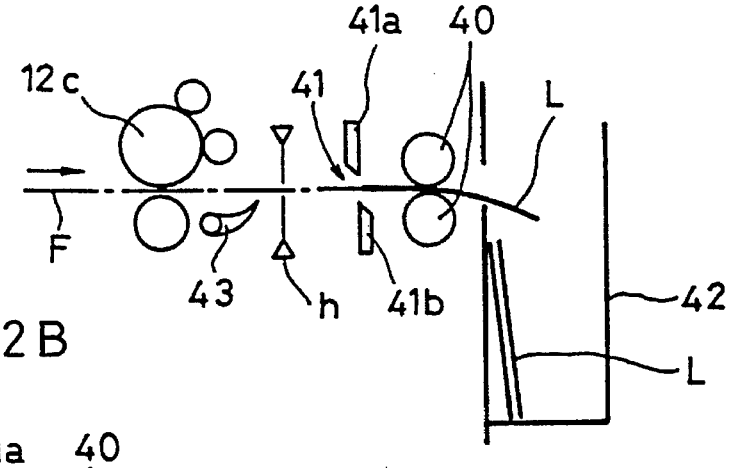
FIGS. 12A–12D are views explaining the operation of the same.
Figure 12B:
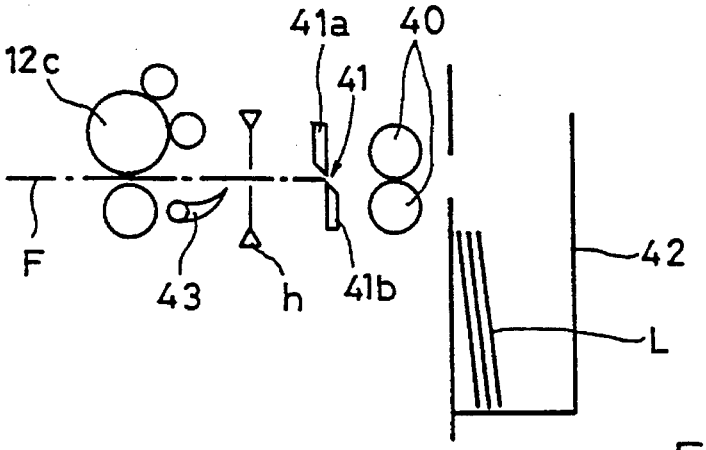
Figure 12C:
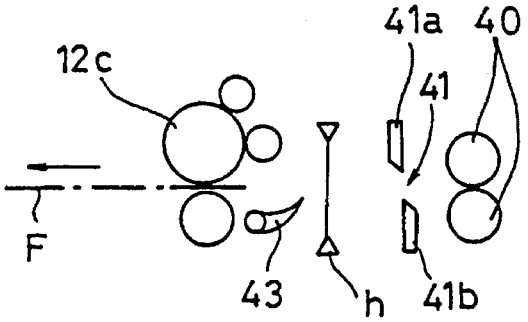

Downstream of the fourth film stocking unit Q4 is provided a leader separating means R. As shown in FIGS. 10–12, the leader separating means R comprises a cutter 41 made up of upper and lower blades 41a, 41b, a leader stocker 42 and a guide 43. A film F having a leader L attached thereto is fed until its end protrudes from delivery rollers 40 as shown in FIGS. 10 and 12A and then cut by the cutter 41 as shown in FIG. 12B to separate the leader L from the film. The cutter 41 is activated when the feed rollers 12c have turned a predetermined time period after detecting the leader L by the sensor h. The leader L thus cut apart is fed by the delivery rollers 40 and dropped into the leader stocker 42.

Figure 12D:
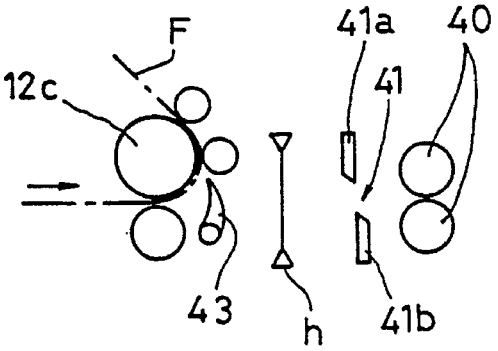
Figure 13:
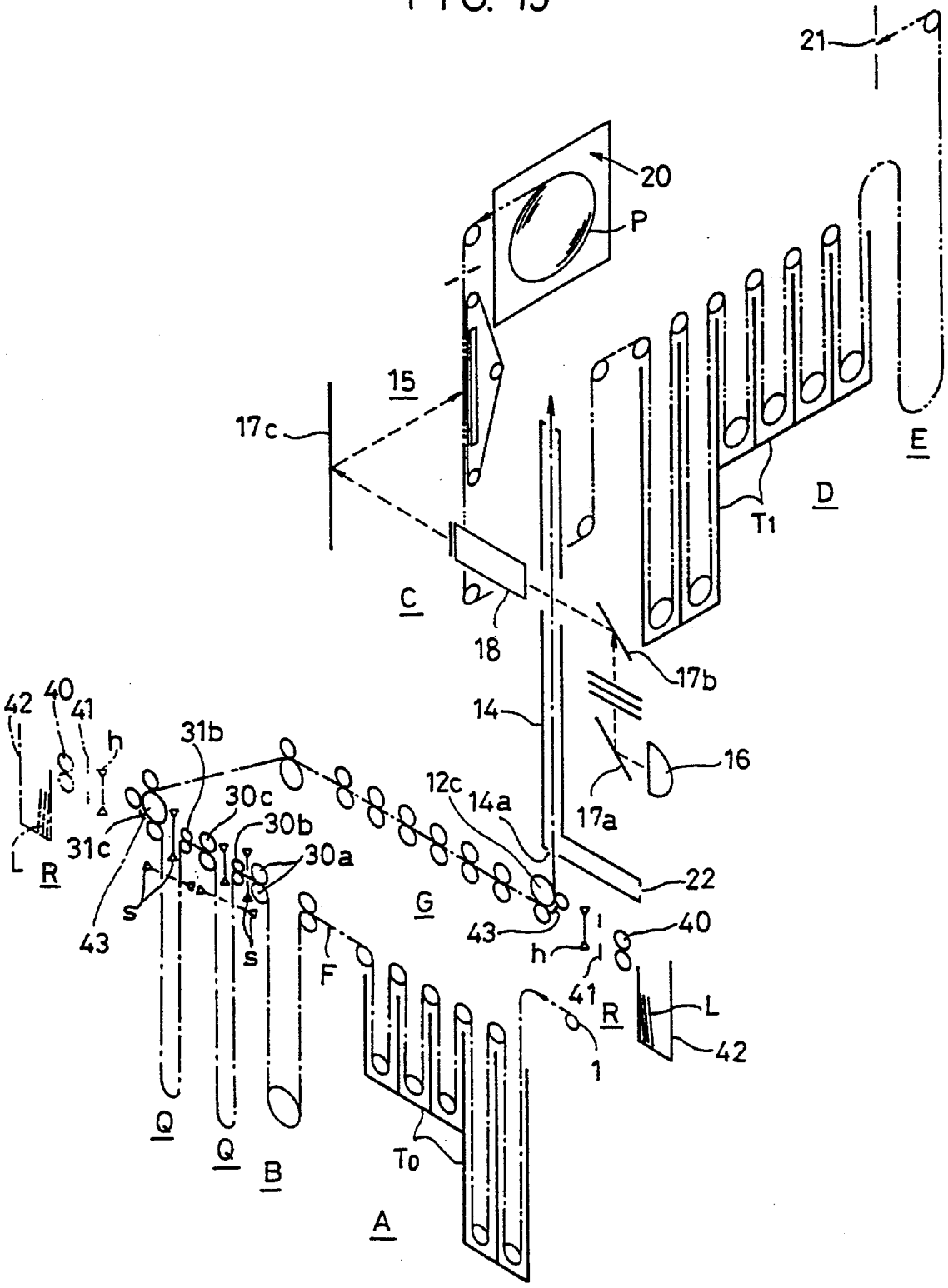
FIG. 13 is a schematic perspective view of another embodiment.

The guide 43, provided near the feed rollers 12c, is kept out of the film feed path, allowing smooth feed of the leader L (film F). When the leader L is cut apart and dropped into the leader stocker 42, the feed rollers 12c turn in reverse, rewinding the film F to the position shown in FIG. 12C. The guide 43 is erected in this state as shown in FIG. 12D. Then, the film F is fed forward again and turned upwards by the guide 43. The guide 43 is moved out of the film feed path by a rotary solenoid provided coaxially with the shaft of the guide 43 and returned to the erect position by a spring 43a. The delivery rollers 40 and feed rollers 12c are driven by a pulse motor 50a, while the feed rollers 12a are driven by a pulse motor 50b.

In FIG. 10, numeral 48 indicates a film guide for bending the film F downwards. As shown in FIG. 11B, it is pivotally mounted on a guide roller 12d. Normally, it is kept in the position shown by solid line in FIG. 10 by a spring 48a. When the leader L is inserted under the film guide 48 as shown by two-dot chain line in FIG. 11B, the film guide 48 is raised to the position shown by chain line in FIG. 10. When the film F is subsequently inserted under the film guide 48 as shown by dotted line in FIG. 11B, the film guide 48 will return to the position shown by solid line in FIG. 10 because the film is narrower than the leader L. The film F is thus bent downwards. Thus, by feeding the film by the feed rollers 12a, the loop L4 as shown by chain line in FIG. 10 can be formed smoothly. Similar film guides 48 should be provided in the other film stocking units Q1 . . . .

When the leading end of the film (leader L) is moved forward and backward by the feed rollers 12a, the length of the loop L4 formed in the film stocking unit Q2 decreases and increases. Thus, the movement of the film leading end when separating the leader L has no influence on the steps in the preceding units including the straight forward unit G.

When all the frames of the film F in the printing unit C are printed, this film F is discharged. Then, the film F stocked in the film stocking unit Q4, with its leading end turned upward as shown in FIG. 12D, is fed toward an exposure unit 15 through the negative mask 14 by the feed roller 12c, which is located behind the unit Q4.

In the exposure unit 15, the light from a light source 16 is emitted through two mirrors 17a, 17b against the film F fed into the exposure unit 15 (FIG. 5). The images on the film F are enlarged by a printing lens 18 and printed through a mirror 17*c* on printing paper P pulled out onto an exposure table 19.

The printing paper P is stored in a magazine 20 in the form of a roll and pulled out onto the exposure table 19. After printing, the paper P is developed by being fed through various treating solutions in a plurality of treating tanks T1 in the developing unit D. The paper thus developed is then fed through the drying unit E and sent out through a discharge port 21 into a sorter H.

Besides the film inlet 14*a*, the negative mask 14 has another film inlet 22 for inserting films for extra printing or make-over. Film F fed through the inlet 22 is processed in the printing unit C in exactly the same way as the films fed through the inlet 14*a*. Namely, their images are printed onto printing paper P, which is subsequently developed and dried.

When a film F is fed into the negative mask through its inlet 22 while processing films fed through the inlet 14*a*, after discharging the film F in the printing unit C, the film in the fourth film stocking unit Q4 is not fed toward the printing unit C but stored in the unit Q4 in the form of a loop L4. In this state, the developed film F fed into the third film stocking unit Q3 will not be sent to the unit Q4 but be kept in the unit Q3 in the form of a loop L3. If the loop L3 is already formed in the unit Q2, the film F is stocked in the unit Q2 in the form of a loop L2. If the loop L2 is already formed in the unit Q2, the film F is stocked in the unit Q1 in the form of a loop L1. Thus, extra printing and make-over steps can be carried out without affecting the ordinary steps for developing and drying films.

Printing processes are carried out continuously thereafter. If the developing becomes not continuously but intermittent, irrespective of the length of interval, the portions of the film F in the film stocking units Q1–Q4 are fed one after another to the printing unit for printing.

If the film F requiring a rather long time for exposure is in the printing unit C, the following film is stored in the fourth film stocking unit Q4. If a loop is already formed in the unit Q4, films are stocked in the form of loops in the film stocking units Q3, Q2 and then Q1 in the manner as described above.

Predetermined ones of the feed rollers 6*a* . . . , 9*a* . . . , 11*a* . . . , 12*a* . . . , 13 . . . , which are arranged from the film processor to the leader separating means R, are hourglass-shaped with the central portions cut away as shown in FIG. 6. The film F is fed through such central cut-away portions. Since the leader L is wider than the cut-away portions, it is fed sandwiched between the feed rollers 9*a* . . . , while the image-carrying surface of the film F is kept out of contact with any of the rollers.

In the above embodiment, the second film stocking unit Q2 is moved so that the film F feed direction will not be in a single vertical plane. But the leader separating means R of this invention can also be used in the arrangement shown in FIG. 13, in which the film feed path from the film drying unit B (film processor) to the straight feed unit G (printer processor) extends vertically. In this arrangement, the fourth film stocking unit Q4 is provided upstream of the guide 43. The leader separating means may be provided at a turning point of the aforementioned vertical film feed path as shown by chain line in FIG. 13. This apparatus also has film stocking units Q similar to those in the first embodiment, feed rollers 30*a*, 30*c* and 31*c*, free press rollers 30*b*, 31*b*, and sensors S.

Figure 14:
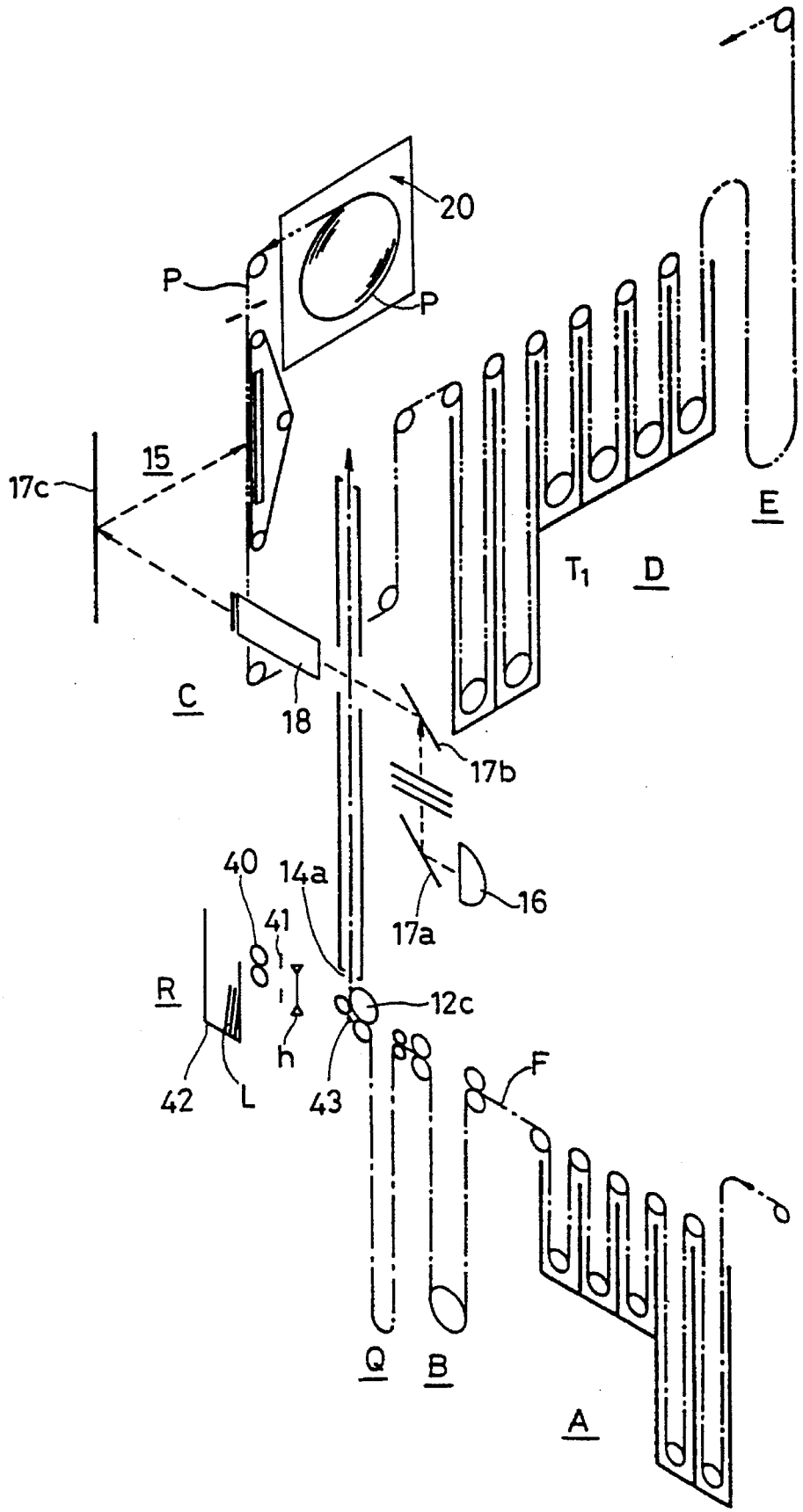
FIG. 14 is a schematic perspective view of a further embodiment.
Figure 15:
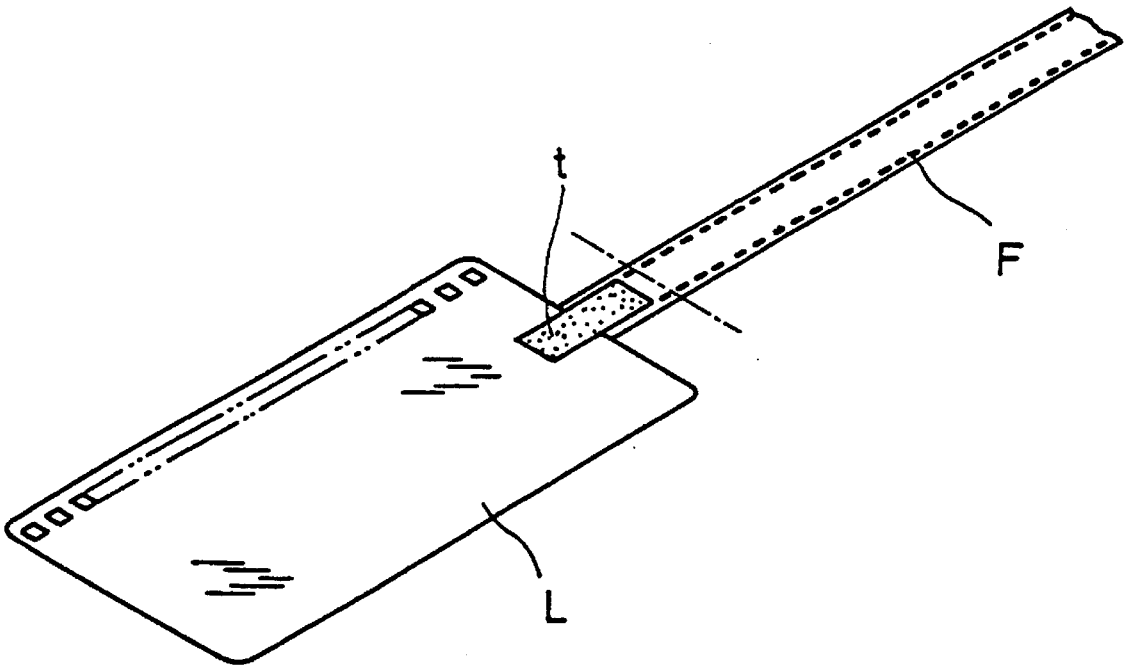
FIG. 15 is a perspective view of a film having a leader attached thereto.
Figure 16:
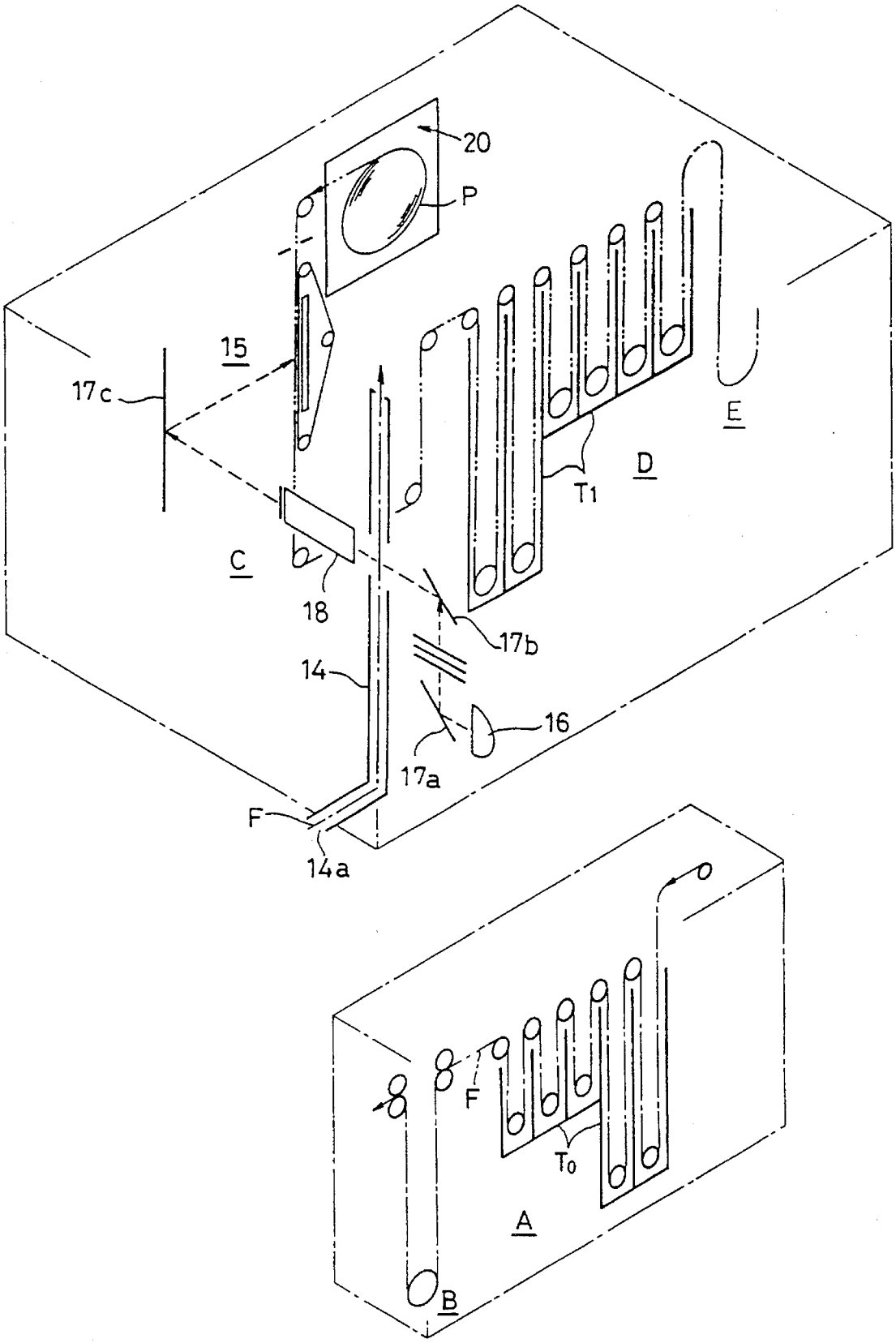
FIG. 16 PRIOR ART
FIG. 16 is a schematic perspective view of the prior art.

Also, as shown in FIG. 14, the leader separating means R of this invention is applicable to an arrangement in which the film inlet 14*a* of the printer processor is provided immediately downstream of the film stocking unit Q (of the film processor) that is located downstream of the film drying unit B. In this case, the leader separating means R is provided at a turning point of the film feed direction.

What is claimed is:

1. In a photographic processing machine comprising a film developing unit, a film drying unit, a printing unit, a photographic paper developing unit and a photographic paper drying unit that are arranged continuously, a method of separating a leader from a film, said method comprising the steps of feeding a film having a leader attached to the leading end thereof through the film developing unit and the film drying unit to develop and dry the film, separating the leader from the film, feeding the film into the printing unit, and feeding photographic paper through the printing unit, the photographic paper developing unit and the photographic paper drying unit to print images on the film onto the photographic paper and to develop and dry the photographic paper, characterized in that the film with the leader is fed until it protrudes from a turning point where the film feed direction in the film feed path extending from the film drying unit to the printing unit changes, stopping the feed of the film with the leader at said turning point, cutting off the leader from the film, moving the film backwards until its leading end comes back to the turning point, and feeding the film along the film feed path leading to the printing unit into the printing unit.

2. A photographic processing machine comprising a film developing unit, a film drying unit, a printing unit, a photographic paper developing unit and a photographic paper drying unit that are arranged continuously, wherein a film having a leader attached to the leading end thereof is fed through the film developing unit and the film drying unit to develop and dry the film, and wherein photographic paper is fed through the printing unit, photographic paper developing unit and photographic paper drying unit to print images on the film onto the photographic paper and to develop and dry the photographic paper, characterized in that the film feed path extending from said film drying unit to said printing unit has a turning point at which its direction is changed, and that said processing machine further comprises a roller provided at said turning point for feeding the film back and forth, a guide provided at said turning point for selectively feeding the film straight ahead or toward the printing unit, and a cutter provided downstream of said guide for cutting off the leader.

3. A photographic processing machine as claimed in claim 2 further comprising film stocking units in which the film can be stored in the form of length-adjustable loops.

* * * * *